US012553428B2

(12) United States Patent
Cappelli et al.

(10) Patent No.: US 12,553,428 B2
(45) Date of Patent: Feb. 17, 2026

(54) RECIPROCATING COMPRESSOR VALVE SYSTEM WITH EMBEDDED SENSOR

(71) Applicant: NUOVO PIGNONE TECNOLOGIE—S.R.L., Florence (IT)

(72) Inventors: Federico Cappelli, Florence (IT); Federico Puccinelli, Florence (IT); Guido Gori, Florence (IT); Riccardo Maleci, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/713,451

(22) PCT Filed: Nov. 18, 2022

(86) PCT No.: PCT/EP2022/025524

§ 371 (c)(1),
(2) Date: May 24, 2024

(87) PCT Pub. No.: WO2023/094023

PCT Pub. Date: Jun. 1, 2023

(65) Prior Publication Data

US 2025/0027489 A1 Jan. 23, 2025

(30) Foreign Application Priority Data

Nov. 25, 2021 (IT) ..... 102021000029873

(51) Int. Cl.
*F04B 39/10* (2006.01)
*F04B 51/00* (2006.01)

(52) U.S. Cl.
CPC ..... *F04B 39/1053* (2013.01); *F04B 51/00* (2013.01); *F04B 2205/08* (2013.01); *F04B 2205/111* (2013.01)

(58) Field of Classification Search
CPC .. F04B 39/1053; F04B 51/00; F04B 2205/08; F04B 2205/111
See application file for complete search history.

(56) References Cited

U.S. PATENT DOCUMENTS 6,485,265 B2 11/2002 Schroeder et al.
7,318,350 B2 1/2008 Boken
(Continued)

FOREIGN PATENT DOCUMENTS

CN 110 145 449 A 8/2019
EP 3 339 812 A1 6/2018

OTHER PUBLICATIONS

Guerra, Christopher J, "Condition monitoring of reciprocating compressor valves using analytical and data-driven methodologies", Feb. 1, 2013.

(Continued)

*Primary Examiner* — Shafiq Mian
(74) *Attorney, Agent, or Firm* — Paul Frank + Collins P.C.

(57) ABSTRACT

The valve system, to be used as a suction valve and/or as a discharge valve in a reciprocating compressor, comprises a valve body, at least one sensor mounted on the valve body and configured to detect a parameter associated to operation of the valve device, and a wireless communication unit electrically coupled to the at least one sensor and configured to transmit information detected by the at least one sensor; the at least one sensor is associated with a fixing member that is inserted in holes of the valve body and that seals the holes. The innovative valve system may comprise further at least one energy harvesting system, which could be for example thermoelectric or piezoelectric, located preferably in or on or at the valve body.

20 Claims, 4 Drawing Sheets

(56) References Cited

U.S. PATENT DOCUMENTS

| | | | | |
|---|---|---|---|---|
| 8,984,930 | B2 | 3/2015 | Worden et al. | |
| 9,759,213 | B2 | 9/2017 | Bassett et al. | |
| 10,113,552 | B2 | 10/2018 | Zhang et al. | |
| 10,948,358 | B2 | 3/2021 | Lanzani et al. | |
| 2001/0031203 | A1* | 10/2001 | Schroeder | F04B 39/1033 417/442 |
| 2010/0106458 | A1 | 4/2010 | Leu et al. | |
| 2011/0071774 | A1* | 3/2011 | Fonda | H02S 10/20 702/50 |
| 2011/0172828 | A1 | 7/2011 | Schmidt et al. | |
| 2013/0298857 | A1* | 11/2013 | Gillette, II | E21B 47/007 123/90.38 |
| 2014/0134030 | A1* | 5/2014 | Stover | F04C 18/0207 418/55.1 |
| 2018/0136050 | A1 | 5/2018 | Lanzani et al. | |
| 2021/0180693 | A1* | 6/2021 | Lim | F25B 31/023 |
| 2022/0356874 | A1* | 11/2022 | Kornfeld | F04B 39/102 |

OTHER PUBLICATIONS

Guo , et al., "Fault detection of reciprocating compressor valve based on one-dimensional convolutional neural network", Apr. 29, 2020.

Seyoum , et al., "Energy neutral wireless bolt for safety critical fastening", Sep. 26, 2017.

Wang , et al., "Investigation on thermodynamic state and valve dynamics of reciprocating compressors with capacity regulation system and parameter optimization"; Aug. 27, 2019.

* cited by examiner

RECIPROCATING COMPRESSOR VALVE SYSTEM WITH EMBEDDED SENSOR

TECHNICAL FIELD

The subject-matter disclosed herein relates to a valve system with embedded sensor for a reciprocating compressor.

BACKGROUND ART

Reciprocating compressor is one of the most widely used compressor technologies in today's oil and gas industries, since it can compress a variety of gases and has a wide range of applications. In general, the inlet and outlet flow to and from a cylinder of a reciprocating compressor are regulated by suction and discharge valves: the suction valve permit flow into the cylinder but not back out, and the discharge valve permit flow to exit the cylinder but not return back in. Therefore, suction and discharge valves play a key role for the correct operation of the reciprocating compressor. Nowadays, reciprocating compressors are mainly equipped with automatic valves, which are actuated by the pressure difference across the valve.

However, reciprocating compressor still need frequent operation shutdowns due to valve failures or valve maintenance, resulting in costly downtimes. Hence, a proper care in valve design and a correct monitoring of valve operation (in addition to the monitoring of the cylinder operation) would be desirable in order to minimize reciprocating compressor downtimes.

From American U.S. Pat. No. 7,318,350 is known a system and a method to monitor valve operation by detecting acoustic emission of a valve and to compare it with a baseline acoustic emission of the valve detected for a predetermined period of operation in order to identify valve anomalies in dependence on differences in the real acoustic emission and the baseline acoustic emission.

From American U.S. Pat. No. 6,485,265 is known a valve configuration having an indicator port on the fixed member and allowing a sensor to be mounted on the valve or within the valve. The sensor is a wired sensor which transmits a condition of the gas which is inside the cylinder in order to monitor cylinder condition and performance but without information about the condition of the valve itself.

SUMMARY

According to an aspect, the subject-matter disclosed herein relates to a valve system to be used as a suction valve and/or as a discharge valve in a reciprocating compressor. The innovative valve system comprises a valve body and at least one sensor mounted on the valve body and configured to detect a parameter associated to operation of the valve in order to assess the health of the valve, and for example also to determine the maintenance timing of the valve and/or the compressor and/or to predict the remaining life of the valve and/or the compressor; the at least one sensor is associated with a fixing member that is inserted in holes of the valve body and that seals the holes. The innovative valve system comprises further a wireless communication unit configured to transmit the information detected by the sensor(s) far from where the valve system is mounted. Advantageously, the innovative valve system comprises further at least one energy harvesting system, which could be for example thermoelectric (=TEG) or piezoelectric (=PEG), located preferably in or on or at the valve body.

According to another aspect, the subject-matter disclosed herein relates to a reciprocating compressor arranged to process a gas and including at least one innovative valve system. For example, the innovative valve system may be particularly advantageous in reciprocating compressor arranged to process a dirty gas, which may contain solid and/or liquid particles that may affect the correct functioning of the compressor valves, or in reciprocating compressor stations not physically monitored (for example equipped with global remote diagnostics). For both these applications, it may be useful to reliably assess the health of the valve. Another particularly advantageous application of the innovative valve system may be in reciprocating compressor systems which have "low availability" due to the presence, for example, of only one reciprocating compressor, so that in case of failure of the only reciprocating compressor there is not another reciprocating compressor available that may replace totally or partially its service. For this application, it may be useful to avoid failure of any valve by predicting its failure or to correctly schedule their maintenance in order to avoid long interruptions of the system operation.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
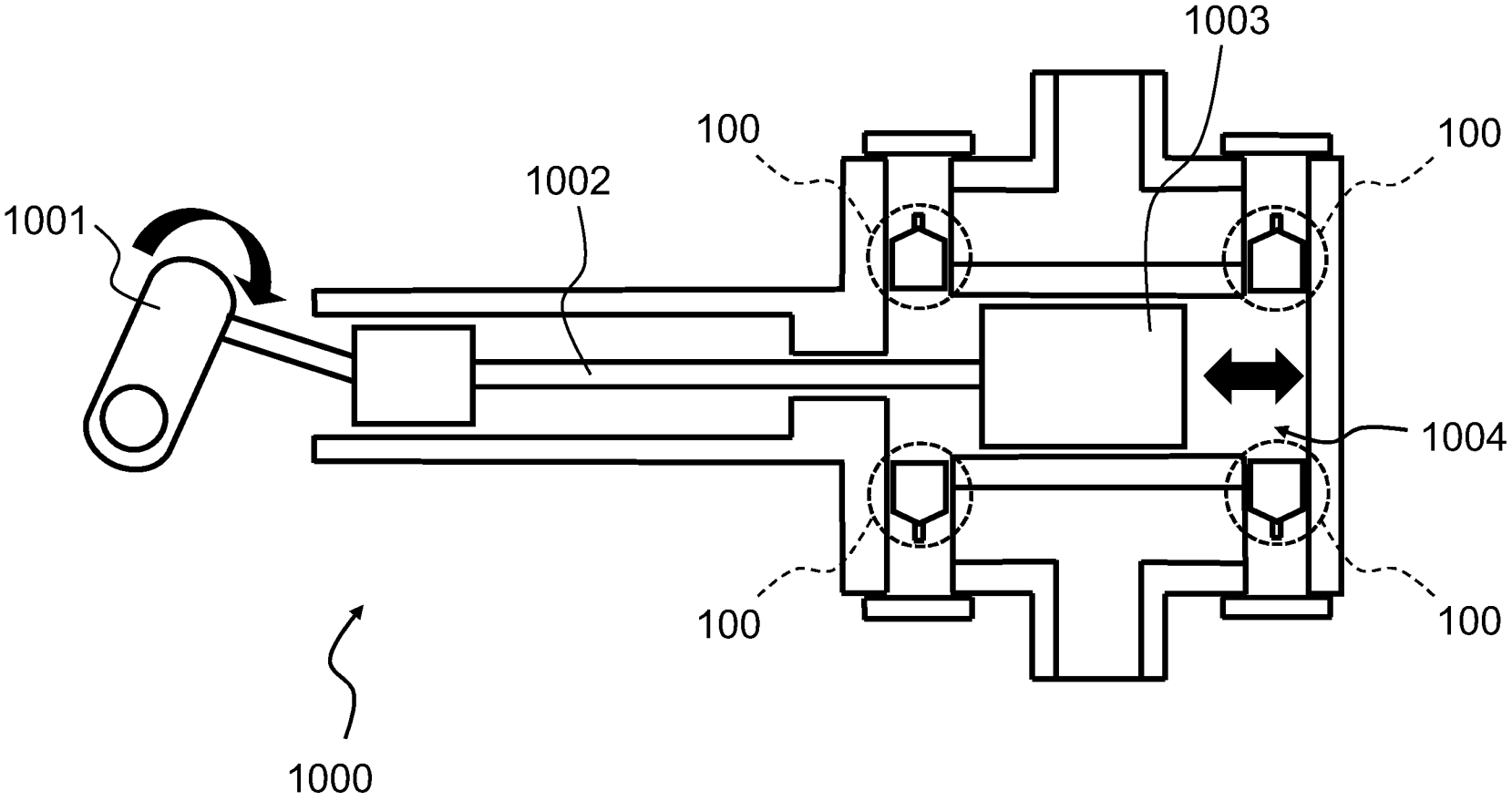
FIG. 1 shows a simplified cross-sectional view of a reciprocating compressor wherein an embodiment of an innovative valve system is used for example for all the four valves shown in the figure.

According to an aspect, the subject-matter disclosed herein relates to a valve system which can be used in a reciprocating compressor. Typically, a reciprocating compressor has at least one suction valve to suck (uncompressed, i.e. at low pressure) process gas into the cylinder and at least one discharge valve to discharge (compressed, i.e. at high pressure) process gas out of the cylinder. The innovated valve system disclosed herein can be used both as a suction valve and discharge valve.

The innovative valve system includes at least one sensor that measures a parameter just associated to operation of the valve; the parameter may be for example a temperature at the valve (for example just before, just after, or inside), a temperature difference across the valve, a pressure at the valve (for example just before, just after, or inside), a temperature difference across the valve, a vibration in the valve or in a component of the valve, a strain in the valve or in the component of the valve; there may be more than one sensor.

The innovative valve includes also a wireless communication unit that transmits information generated by the sensor or sensors. Such information can be used to assess the health of the valve (for example its wear) without the need of any cable inside the reciprocating compressor, Furthermore, it is possible for example to determine the maintenance timing of the valve and/or the compressor and/or to predict the remaining life of the valve and/or the compressor.

The innovative valve system may include further a system internal to valve system for generating electric energy for powering the sensor or sensors and/or the communication unit so that there is no need for any power supply cable connected to the valve system.

Reference now will be made in detail to embodiments of the disclosure, an example of which is illustrated in the drawings. The example is provided by way of explanation of the disclosure, not limitation of the disclosure. In fact, it will be apparent to those skilled in the art that various modifications and variations can be made in the present disclosure without departing from the scope or spirit of the disclosure, in particular the scope of the appended claims. In the following description, similar reference numerals are used for the illustration of figures of the embodiments to indicate elements performing the same or similar functions. Moreover, for clarity of illustration, some references may be not repeated in all the figures.

In FIG. 1 there is schematically shown an embodiment of an innovative valve system 100 integrated in a typical reciprocating compressor 1000. According to FIG. 1, the reciprocating compressor 1000 has a crankshaft 1001 configured to convert a rotational motion into a reciprocating motion (see the big black arrows). A connecting rod 1002 mechanically couples the crankshaft 1001 and a piston 1003, the piston being configured to compress a process gas inside a cylinder 1004. In other words, the piston 1003 is driven in a reciprocation motion by the crankshaft 1002. As it will be apparent from the following, the innovative valve system may replace a traditional valve system without the need of any adaptation to the reciprocating compressor; this is a big advantage.

In the reciprocating compressor 1000, the process gas is sucked into the cylinder 1004 by at least one suction valve, it gets compressed by the piston 1003 and it is discharged from the cylinder 1004 by at least one discharge valve. The valves are typically automatic valves which works thanks to the difference between the pressure inside the cylinder 1004 and the suction pressure of process gas (suction valves) and the pressure inside the cylinder 1004 and discharge pressure of process gas (discharge valves). For example, in FIG. 1 are schematically represented two suction valves in the upper portion of the cylinder 1004 (with respect to the translation movement of the piston 1003) and two discharge valves in the lower side of the cylinder 1004 (with respect to the translation movement of the piston 1003) which put the cylinder 1004 in fluid communication respectively with a suction manifold and a discharge manifold. In particular, in FIG. 1 are represented four innovative valve systems 100, each valve system 100 comprising a valve configured to control flow of the process gas, where two of the valve systems 100 works as a suction valve and two of the valve systems 100 works as a discharge valve.

Figure 2:
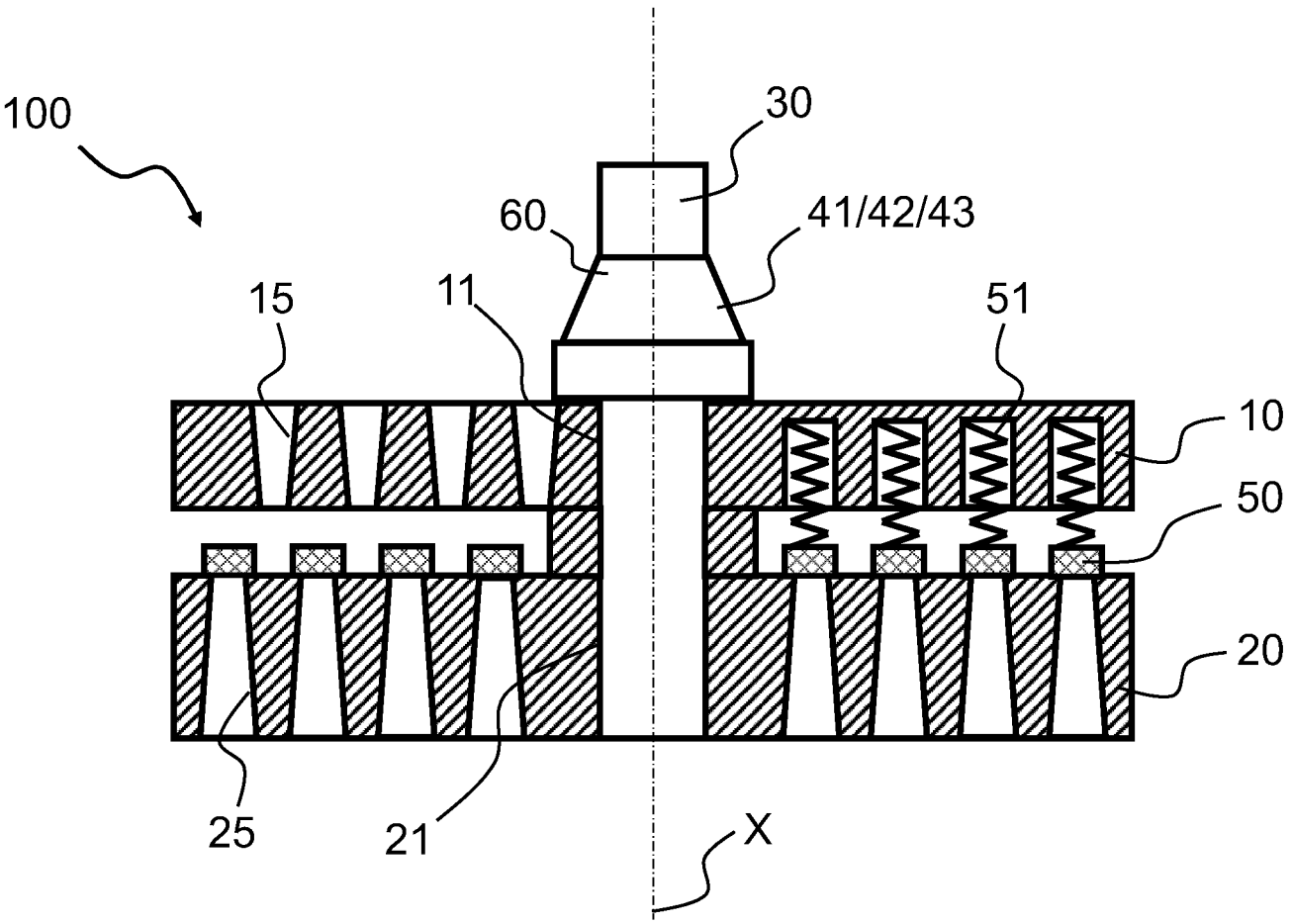
FIG. 2 shows a more detailed cross-sectional view of a valve system of FIG. 1 that is in particular configured to work as a discharge valve.

The innovative valve system 100 is better represented in FIG. 2, which is a cross-sectional view of an innovative valve system configured to work as a discharge valve: the valve device (that is often called simply "valve" inside the present description) of the valve system comprises a valve body (in the embodiment of FIG. 2 corresponding to the combination of members 10 and 20) having a plurality of openings 15 and 25, and at least one moveable member 50. A process gas path is defined at least partially by the openings 15 and 25 and the at least one moveable member 50 is configured to open and close the process gas path.

The valve system 100 comprises further at least one sensor 41, 42, 43 mounted on the valve body and configured to detect a parameter associated to operation of the valve and a wireless communication unit 60 electrically coupled to the at least one sensor 41, 42, 43 and configured to transmit information detected by the at least one sensor 41, 42, 43. In FIG. 1, all the sensors and the unit are shown schematically as being all integrated into a fixing member of the valve body.

With non-limiting reference to FIG. 2, there are shown four ring-shaped moveable members 50 which develop around an axis X of the valve body. Advantageously, the valve body comprises a seat valve plate 20 and a counter seat valve plate 10, typically a disk-shaped seat valve plate 20 and a disk-shaped counter seat valve plate 10, which are mechanically coupled by a fixing member 30, for example a tie rod or a stud or a screw. The at least one sensor 41, 42, 43 is associated with the fixing member 30. In FIG. 2, the gas flow is from the bottom (in the cylinder of the compressor) to the top (in the discharge manifold fluidly coupled to the cylinder of the compressor), i.e. the gas flows first through the openings 25 in the seat valve plate 20 and then through the openings 15 in the counter seat valve plate 10 when the at least one moveable member 50 is configured to open the process gas path. It is to be noted that the terms "seat valve plate" and "counter seat valve plate" are used herein according to conventional terminology common in the art; however, the opposite terminology might also be used.

According to another possibility, moveable members 50 may be a poppet or a slat. It is to be noted that moveable members 50 are arranged between the seat valve plate 20 and the counter seat valve plate 10; advantageously, the valve plates 10, 20 are spaced apart, for example by means of a fixed spacer arranged between the seat valve plate 20 and the counter seat valve plate 10.

According to the embodiment shown in FIG. 2, the seat valve plate 20 has a first plurality of openings 15 and the counter seat valve plate 10 has a second plurality of openings 20. The first plurality of openings 15 are in particular through holes or slots which fluidly connect a discharge manifold of the reciprocating compressor 1000 to the space between the seat valve plate 20 and the counter seat valve plate 10. The second plurality of openings 25 are in particular through holes or slots which fluidly connect the space between the seat valve plate 20 and the counter seat valve plate 10 to the cylinder 1004 of the reciprocating compressor 1000.

Advantageously, the moveable members 50 are mechanically connected to the counter seat valve plate 10, for example by means of an elastic element 51, in particular a spring. With non-limiting reference to FIG. 2, the moveable members 50 are arranged to plug the openings 25 of the seat valve plate 20 due to the elastic force of the elastic element 51, in order to close the process gas path between the first plurality of openings 15 and the second plurality of openings 25. When a differential pressure force acting on the free section of the elastic element 51, i.e. the section which is not connected to the counter seat valve plate 10, due to the pressure inside the cylinder 1004, is higher than the elastic force of the elastic element 52, the moveable members 50 are forced to move (upward in FIG. 2) and to open the process gas path defined by openings 15 and 25.

According to the embodiment shown in FIG. 2, both the seat valve plate 20 and the counter seat valve plate 10 have a hole 21, 11 and the fixing member 30 (with associated at least one sensor 41, 42, 43) passes through the hole 11 of the counter seat valve plate 10 and the hole 21 of the seat valve plate 20 and seals holes 11, 21 where fixing member 30 is inserted (specific sealing devices may be provided with the fixing member in order to perform this function). It is to be noted that the holes 11, 21 of the embodiment of FIG. 2 are through holes; however, according to another possibility, the hole 11 and/or the hole 21 may be blind holes. According to still another possibility, the fixing member 30 may be integrated, for example, with the seat valve plate 20 and pass through the hole 11 of the counter seat valve plate 10; in this case, there is no need to have a hole 21 in the seat valve plate 20. According to the advantageous embodiment of FIG. 2, holes 11 and 21 and both central holes.

Advantageously, the at least one sensor 41, 42, 43 mounted to the valve body, in particular to the fixing member 30, is configured to detect:

- a physical property of the process gas at the valve,
- or
- a physical property difference of the process gas across the valve,
- or
- a strain in the valve body, in particular in a fixing member of the valve body,
- or
- vibrations in the valve, in particular vibrations of the valve body or the movable member in particular specifically due to operation of the valve (not the movement of the piston).

For example, the at least one sensor 41, 42, 43 is a strain gauge. Advantageously, the physical property of the process gas at the valve detected by the at least one sensor 41, 42, 43 is a temperature of the process gas or a pressure of the process gas for example just before the valve body or just after the valve body or inside the valve body (for example between the seat valve plate and the counter seat valve plate). Advantageously, the physical property difference of the process gas across the valve detected by the at least one sensor 41, 42, 43 is a temperature difference of the process gas or a pressure difference of the process gas across the valve. It is to be noted that a temperature of the gas flowing through the valve may correspond to a temperature of a component of the valve.

According to a first embodiment, the valve system 100 comprises at least two sensors configured to detect different physical properties or different physical properties differences. For example, the fixing member 30 of the valve system 100 may have associated a first sensor 41 configured to detect a temperature of the process gas at the valve and a second sensor 42 configured to detect a pressure of the process gas at the valve. According a second embodiment, the fixing member 30 of the valve system 100 may have associated a first sensor 41 configured to detect a temperature difference of the process gas across the valve and a second sensor 42 configured to detect a pressure difference of the process gas across the valve. According to a third embodiment, the fixing member 30 of the valve system 100 may have associated a first sensor 41 configured to detect a temperature difference of the process gas across the valve and a second sensor 42 configured to detect vibrations in the valve. According to a fourth embodiment, the fixing member 30 of the valve system 100 may have associated a first sensor 41 configured to detect a first temperature of the process gas at a first portion of the valve, a second sensor 42 configured to detect a second temperature of the process gas at a second portion of the valve and a third sensor 43 configured to detect a pressure difference of the process gas across the valve. It is to be noted that many other different embodiments are possible.

Figure 3:
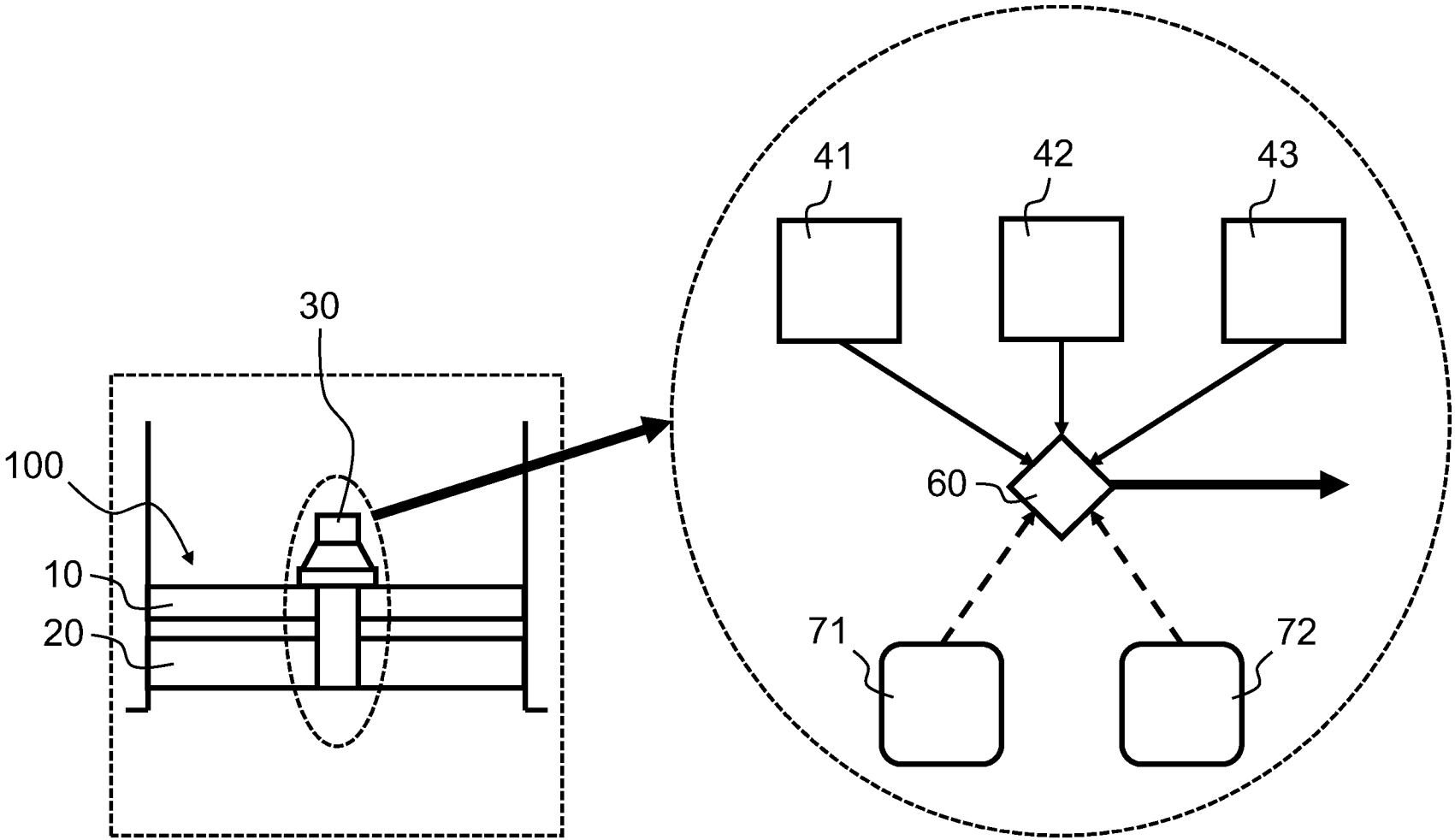
FIG. 3 shows a simplified cross-sectional view of the valve system of FIG. 1 wherein the electronic part is highlighted.

According to a preferred embodiment, shown for example in FIG. 3, the fixing member 30 of the valve system 100 has associated a first sensor 41 configured to detect a temperature difference of the process gas, a second sensor 42 configured to detect a pressure difference across the valve and a third sensor 43 configured to detect strain in the valve body, in particular in the fixing member 30 of the valve body. As shown in FIG. 3, the wireless communication unit 60 is electrically coupled to the sensors 41, 42, 43 and in particular receives the information detected by the sensors 41, 42, 43 (see the three arrows which connects the sensors 41, 42, 43 to the wireless communication unit 60); after, having received the information from the sensors 41, 42, 43, the wireless communication unit 60 is configured to transmit these information, in particular far from where the valve system 100 is mounted (see the big black arrow departing from the wireless communication unit 60).

Advantageously, the valve system 100 comprises further a thermoelectric energy harvesting system 71 configured to supply electric energy to the at least one sensor 41, 42, 43 and/or to the communication unit 60. Preferably, the thermoelectric energy harvesting system 71 is located in or on or at the valve body.

Advantageously, the thermoelectric energy harvesting system 71 is configured to generate electric energy based on a temperature difference across the valve and supply the electric energy generated to the at least one sensor 41, 42, 43 and/or to the communication unit 60. In particular, the temperature difference across the valve, for example the temperature difference between the cylinder 1004 and the discharge manifold, enable electrons in the thermoelectric energy harvesting system 71 to flow and generate electric energy.

Advantageously, the thermoelectric energy harvesting system 71 comprises a sensor configured to detect a temperature difference. In other words, for example, at least one sensor may be integrated into the thermoelectric energy harvesting system 71.

Advantageously, the valve system 100 comprises further a piezoelectric energy harvesting system 72 configured to supply electric energy to the at least one sensor 41, 42, 43 and/or to the communication unit 60. Preferably, the piezoelectric energy harvesting system 72 is located in or on or at the valve body.

Advantageously, the piezoelectric energy harvesting system 72 is configured to generate electric energy based on a pressure difference across the valve and supply the electric energy generated to the at least one sensor 41, 42, 43 and/or to the communication unit 60. In particular, the pressure difference across the valve, for example the pressure difference between the cylinder 1004 and the discharge manifold, causes vibrations in the valve and enable electrons in the piezoelectric energy harvesting system 72 to flow and generate electric energy.

Advantageously, the piezoelectric energy harvesting system 72 comprises a sensor configured to detect a pressure difference. In other words, for example, at least one sensor may be integrated into the piezoelectric energy harvesting system 72.

According to the embodiment of FIG. 3, the valve system 100 comprises both a thermoelectric energy harvesting system 71 and a piezoelectric energy harvesting system 72.

Figure 5:
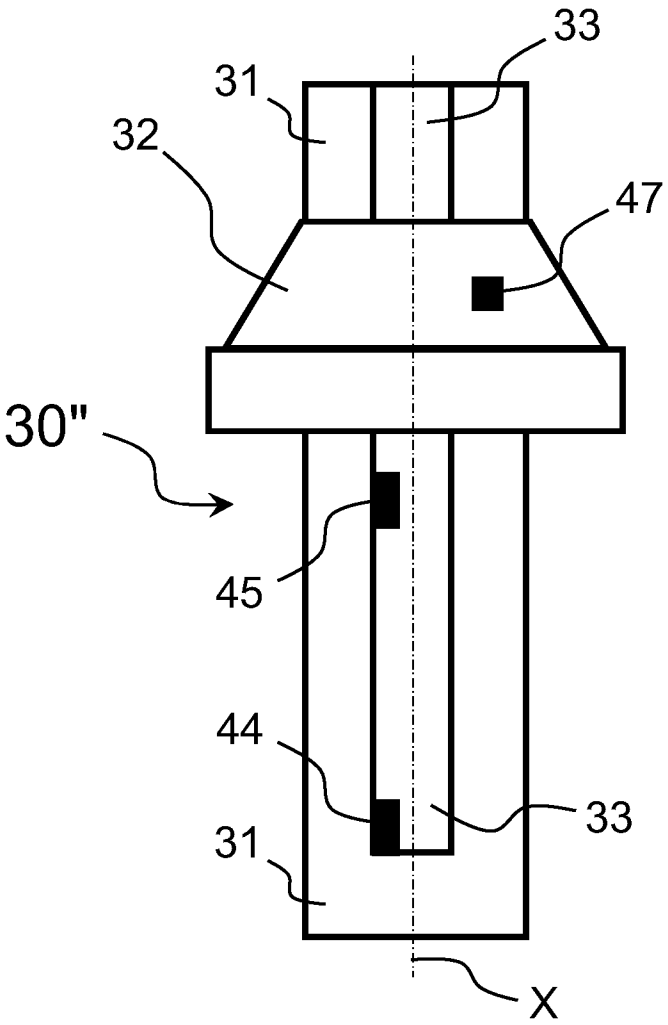
FIG. 5 shows a detailed cross-sectional view of a second embodiment of a fixing member that may be used in the valve system of FIG. 2.
Figure 4:
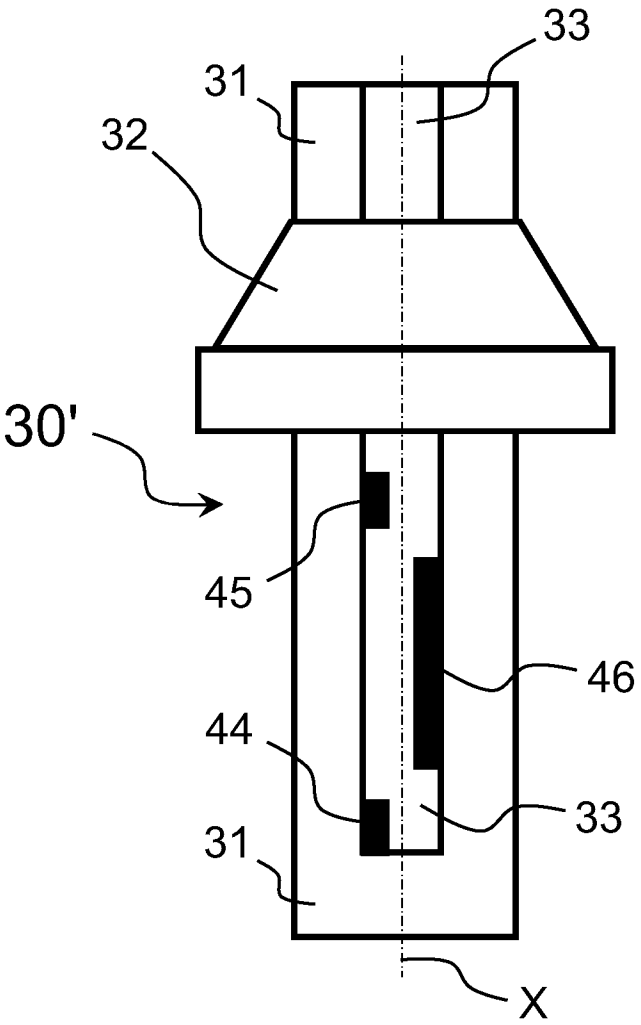
FIG. 4 shows a detailed cross-sectional view of a first embodiment of a fixing member that may be used in the valve system of FIG. 2.

FIG. 4 and FIG. 5 show views of two advantageous embodiments 30' and 30" of a fixing member 30 that may be used in the valve system of FIG. 2.

According to both embodiments of FIG. 4 and FIG. 5, the fixing member is configured to be inserted in a hole (e.g. hole 11) of the counter seat valve plate (e.g. plate 10) and a hole (e.g. hole 21) of the seat valve plate (e.g. plate 20) and to seal seat valve plate, more specifically its hole, and the counter seat valve plate, more specifically its hole, so that no fluid can escape from the compressor cylinder.

According to both embodiments of FIG. 4 and FIG. 5, the fixing member 30' and 30" may comprise a rod-shaped portion 31 and a nut 32 having an internal thread cooperating with an internal thread of the rod-shaped portion 31 in order to provide mechanically coupling of the seat valve plate and the counter seat valve plate. Alternative embodiments of the fixing member has already been described, all of them comprising a rod-shaped portion to be inserted in holes of the valve body, specifically of the the seat valve plate and the counter seat valve plate, and most of them comprising also a nut or a head. The rod-shaped portion may be considered "solid" in the sense that no fluid may pass through it even if it may have an internal hole, specifically an internal blind hole 33, in particular extending parallel to the axis of the rod-shaped portion; the internal hole is blind at the counter seat valve plate so that no fluid can escape from the compressor cylinder.

According to both embodiments of FIG. 4 and FIG. 5, the fixing member 30' and 30" may have a blind hole 33, in particular extending parallel to the axis X of the rod-shaped portion 31; the blind hole 33 is configured to house at least one sensor or at least two sensors or at least three sensors (and possibly cables for connecting such sensors with the wireless communication unit). In the embodiment of FIG. 4, there are three sensors 44, 45 and 46; sensor 44 is for example a temperature sensor configured to detect temperature at the counter seat valve plate of the valve system (such sensor detects directly the temperature of the plate, for example via a wall of the rod-shaped portion, and indirectly the temperature of a fluid flowing flowing through the plate); sensor 45 is for example a temperature sensor configured to detect temperature at the seat valve plate of the valve system (such sensor detects directly the temperature of the plate, for example via a wall of the rod-shaped portion, and indirectly the temperature of a fluid flowing through the plate); sensors 44 and 45 in combination may allow to detect a temperature difference; sensor 46 is for example a strain sensor configured to detect strain in the rod-shaped portion of the fixing member. In the embodiment of FIG. 5, there are two sensors 44 and 45 internal to the rod-shaped portion of the fixing member. According to a variant of the embodiment of FIG. 4, sensor 46 is a vibrations sensor configured to detect vibrations in the valve system.

According to the embodiment of FIG. 5, fixing member 30" comprises a nut 32 (or alternatively a head) configured to house at least one sensor, for example sensor 47; sensor 47 is a vibrations sensor configured to detect vibrations in the valve system.

According to a particularly advantageous embodiment that can be considered a combination of the embodiments of FIG. 4 and FIG. 5, there are at least four sensors, corresponding to e.g. sensors 44. 45, 46 and 47, specifically two temperature sensors, one strain sensor and one vibrations sensor integrated in the fixing element of the valve system, specifically in its rod-shaped portion and/or in its nut or head.

In FIG. 4 and FIG. 5, a wireless communication unit is not shown, not even in a schematic way; in such embodiments or in similar embodiments, a wireless communication unit may be located for example at one end of the rod-shaped portion, i.e. the end designed to be located distally from the compressor cylinder. Similarly, in FIG. 4 and FIG. 5, an energy harvesting system is not shown, not even in a schematic way; in such embodiments or in similar embodiments, an energy harvesting system may be located for example in or on the nut or head distally from the compressor cylinder and closely to the wireless communication unit.

As already explained, an innovative valve system identical or similar to valve system 100 may be advantageously installed and used in reciprocating compressors. Such reciprocating compressor may include one or more such valve system. Preferably, such reciprocating compressor comprises such valve system for each suction and discharge valves.

As already explained, according to some embodiments, an innovative valve system identical or similar to valve system 100 may be advantageously installed as a replacement of a traditional valve system in a reciprocating compressor without the need of any adaptation to the reciprocating compressor. This is advantage derives in particular from the structure of the fixing member of such embodiments (see e.g. fixing members in FIG. 4 and FIG. 5).

The invention claimed is:

1. A valve system for a reciprocating compressor configured to compress a process gas, the valve system comprising:

a valve device configured to control flow of the process gas, the valve device comprising:

a valve body comprising a seat valve plate and a counter seat valve plate, both the seat valve plate and the counter seat valve plate having a central hole and a plurality of openings, the plurality of openings defining a process gas path;

a fixing member disposed in the central hole to mechanically couple the seat valve plate and the counter seat valve plate;

a movable member arranged between the seat valve plate and the counter seat valve plate, the moveable member configured to open and close the process gas path;

a sensor disposed on the valve body and configured to detect a parameter associated with operation of the valve device; and a wireless communication unit electrically coupled to the sensor and configured to transmit information detected by the sensor, wherein the fixing member is configured to seal the central hole in the seat valve plate and the counter seat valve plate, and wherein the sensor is disposed on the fixing member.

2. The valve system of claim 1, wherein the fixing member comprises a rod-shaped portion with a blind hole configured to house at least one sensor.

3. The valve system of claim 2, wherein the blind hole is configured to house at least two sensors.

4. The valve system of claim 1, wherein the fixing member comprises a nut or a head configured to house at least one sensor.

5. The valve system of claim 1, wherein the sensor is configured to detect temperature or pressure of the process gas at the valve device.

6. The valve system of claim 1, wherein the sensor is configured to detect a temperature difference or a pressure difference of the process gas across the valve device.

7. The valve system of claim 1, wherein the valve system comprises two sensors that are configured to detect different physical properties.

8. The valve system of claim 1, wherein the sensor is configured to detect a strain in a fixing member of the valve body.

9. The valve system of claim 1, wherein the valve system comprises two sensors that are configured to detect different physical property differences.

10. The valve system of claim 1, wherein the sensor is configured to detect vibrations of the valve body or the movable member.

11. The valve system of claim 1, further comprising:

a thermoelectric energy harvesting system configured to supply electric energy to at least one of the sensor or the communication unit, wherein the thermoelectric energy harvesting system is disposed on the valve body.

12. The valve system of claim 1, further comprising:

a thermoelectric energy harvesting system configured to supply electric energy to at least one of the sensor or the communication unit, wherein the thermoelectric energy harvesting system is configured to generate electric energy based on a temperature difference across the valve device.

13. The valve system of claim 1, further comprising:

a thermoelectric energy harvesting system configured to supply electric energy to at least one of the sensor or the communication unit, wherein the thermoelectric energy harvesting system comprises a sensor configured to detect a temperature difference.

14. The valve system of claim 1, further comprising:

a piezoelectric energy harvesting system configured to supply electric energy to at least one of the sensor or the communication unit, wherein the piezoelectric energy harvesting system is disposed on the valve body.

15. The valve system of claim 1, further comprising:

a piezoelectric energy harvesting system configured to supply electric energy to at least one of the sensor or the communication unit, wherein the piezoelectric energy harvesting system is configured to generate electric energy based on a pressure difference across the valve device.

16. The valve system of claim 1, further comprising:

a piezoelectric energy harvesting system configured to supply electric energy to at least one of the sensor or the communication unit, wherein the piezoelectric energy harvesting system comprises a sensor configured to detect a pressure difference.

17. A reciprocating compressor comprising at least one valve system according to claim 1.

18. A compressor, comprising:

a discharge manifold;

a cylinder; and a valve comprising:

a valve body with a pair of plates spaced apart from one another;

openings that penetrate through the pair of plates, the openings creating a flow path for process gas;

a tie rod penetrating both the pair of plates;

a spring disposed in at least one of the openings, the spring generating a spring force that opens and closes the process gas path;

a sensor configured to detect a parameter associated with operation of the valve device; and a wireless communication unit electrically coupled to the sensor and configured to transmit information detected by the sensor.

19. The compressor of claim 18, wherein the valve is in position to operate as a suction valve.

20. The compressor of claim 18, wherein the valve is in position to operate as a discharge valve.

* * * * *